US005746068A

United States Patent [19]

Popa et al.

[11] Patent Number: 5,746,068

[45] Date of Patent: May 5, 1998

[54] TWO LAYER INTEGRALLY KNIT LOWER BODY GARMENT

[75] Inventors: Catrinel I. Popa, New York, N.Y.; George A. Browder, Jr., Winston-Salem; Archie Dale Segraves, Clemmons, both of N.C.

[73] Assignee: Sara Lee Corporation, Winston-Salem, N.C.

[21] Appl. No.: 789,189

[22] Filed: Jan. 24, 1997

Related U.S. Application Data

[62] Division of Ser. No. 565,413, Nov. 30, 1995, Pat. No. 5,613,378.

[51] Int. Cl.[6] ..... A41B 9/06; A41D 1/14; D04B 1/24

[52] U.S. Cl. ..... 66/176; 66/171; 66/177; 2/72; 2/213

[58] Field of Search ..... 66/171, 172, 176, 66/177, 172 R, 198; 2/213, 72

[56] References Cited

U.S. PATENT DOCUMENTS

| | | | |
|---|---|---|---|
| 1,349,029 | 8/1920 | Weiss | 2/213 |
| 1,696,714 | 12/1928 | Heller | 2/72 X |
| 1,783,572 | 12/1930 | Johnson | 2/72 |
| 2,000,073 | 5/1935 | Goas | 66/176 |
| 2,498,184 | 2/1950 | Sever | 2/213 |
| 2,837,904 | 6/1958 | Scriggins | 66/176 |
| 3,060,938 | 1/1962 | Kattermann et al. | 66/176 X |
| 5,052,058 | 10/1991 | Mueller | 66/177 X |
| 5,613,378 | 3/1997 | Popa et al. | 66/176 |

*Primary Examiner*—John J. Calvert

*Attorney, Agent, or Firm*—Kilpatrick Stockton LLP; Charles Y. Lackey

[57] ABSTRACT

A lower body garment for covering the legs, hips, waist and midriff of the wearer, formed from a tubular sleeve knit of successive yarn courses which includes a waistband, a midriff encircling portion integrally knit with the waistband and leg portions integrally knit with the midriff encircling portion. The leg portions are formed by slitting the tubular sleeve and joining the slit edges to provide a continuous longitudinal leg enclosing seam extending throughout the leg portions. Cuff portions are integrally knit with the leg portions and are also joined by the continuous longitudinal seam. The garment may be made with or without a lining.

8 Claims, 3 Drawing Sheets

TWO LAYER INTEGRALLY KNIT LOWER BODY GARMENT

REFERENCE TO RELATED APPLICATIONS

This application is a Divisional Application of Ser. No. 08/565,413 filed Nov. 30, 1995, now U.S. Pat. No. 5,613,378.

BACKGROUND OF THE INVENTION

1. Field of the Invention

The present invention relates generally to body garments and more particularly to lower body garments and methods for producing same that are formed from an integrally knit tubular sleeve either with or without garment linings.

2. Description of the Prior Art

Knitted body garments such as conventional pantyhose are usually formed of first and second circularly knit tubes disposed in a side-by-side relationship wherein the tubes are slit, sewn and thereby joined to form a panty portion and separate leg portions. Other knitted body garments are constructed by cutting garment sections from knit fabric and thereafter sewing those sections together to form the finished garment. More recent panty construction involves the provision of a circularly knit seamless tubular garment and thereafter cutting and shaping the garment to form a panty having a minimum number of seams. Examples of this technique are shown in U.S. Pat. Nos. 5,022,240, 5,163,306 and 5,398,346.

Other knitted garments for leisurewear made from knit fabric have been available; however, these garments are usually constructed by the traditional cut and sew procedure, thus involving considerable fabrication time and, in many cases, a decided waste of raw material.

With preferred lower body garment construction to include a circularly knit seamless tubular garment rather than joining pieces or other tubular garments as is done in the conventional construction of pantyhose, there is a need for more sophisticated garment structures embodying such a concept and avoiding the traditional, time-consuming cut and sew procedures heretofore prevalent in the industry. It is to this construction and need that the present invention is directed.

SUMMARY AND OBJECTIVES OF THE INVENTION

In accordance with this invention, a circular knitting machine knits an integrally formed tubular sleeve of successive yarn courses which includes a waistband, a midriff encircling portion integrally knit with the waistband, and leg portions integrally knit with the midriff encircling portions. The leg portions are finished with cuff portions also integrally knit therewith, and the leg portions are formed by slitting opposite faces of the tubular sleeve and joining the slit edges with a continuous longitudinal seam extending from the first cuff portion along the first leg portion, adjacent the midriff encircling portion, along the second leg portion and back to the second cuff portion.

Another embodiment of the present inventive concept includes the provision of an integrally knit lining integrally knit to the waistband that can be everted within the midriff encircling portion and leg portions and secured to the outer portion or shell of the garment along the continuous longitudinal seam after the lining leg portions have been slit, thus securing the lining to the garment along that seam.

As can be seen from this brief description, one of the primary objects of the invention is to provide a total garment from an integrally knit tubular sleeve, thereby avoiding the need for multiple seaming operations.

Another object of the invention is to provide a garment of the type described that can be knit of a variety of fibers so that the lining can be of a more functional and comfortable fiber than the outer dress or shell portion.

Yet another object of the present invention is to provide a garment of the type described that will enable the integral inclusion of a knitted lining that can have reinforced control or support portions within the lining.

Yet still another object of the present invention is to provide an improved method of forming the garment in a novel manner on a circular knitting machine resulting in a simplified and improved garment structure.

Thus, there has been outlined, rather broadly, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments now being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become apparent, are obtained and can be understood in detail, a more particular description of the invention briefly summarized above may be had by reference to the embodiment thereof which is illustrated in the appended drawings, which drawings form a part of this specification and wherein like characters of reference designate like parts throughout the several views. It is to be noted, however, that the appended drawings illustrate only preferred and alternative embodiments of the invention and are therefore, not to be considered limiting of its scope, as the invention may admit to additional equally effective embodiments.

Figure 1:
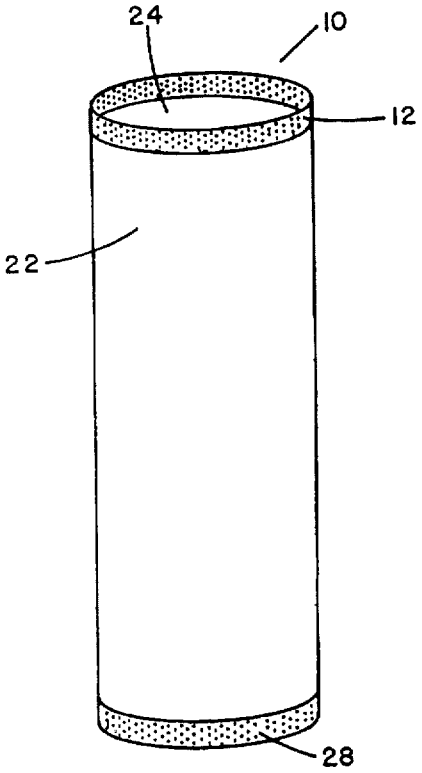
FIG. 1 is a perspective view of the tubular sleeve knit of successive yarn courses which is used to form one embodiment of the present invention.

Referring now to the drawings and particularly to FIG. 1, a unitary seamless knitted tubular sleeve formed of successive yarn courses shown generally as 10 includes a waistband or welt 12 for maintaining the garment in a waist-encircling position on the wearer. A midriff encircling portion 14 is integrally knit with waistband 12 and first and second leg portions 16, 18 are integrally knit with the midriff encircling portion 14 representing the lower portion of sleeve 10. Upon completion of knitting, leg portions 16, 18 are defined by the provision of a slit 20 in the front and back portions 22, 24. The slit edges are seamed together to provide a continuous longitudinal leg-enclosing seam 26 as shown in FIG. 4.

Figure 4:
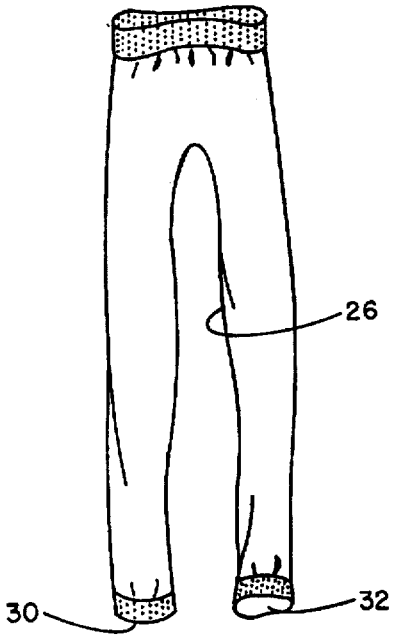
FIG. 4 is a perspective view of the completed garment formed from the tubular sleeve shown in FIGS. 1, 2 and 3.
Figure 5:
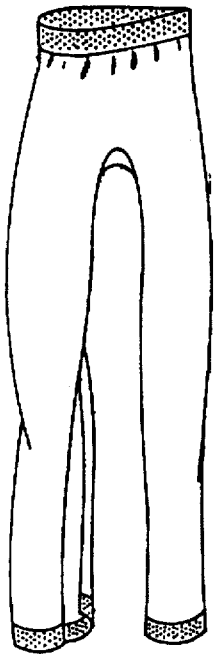
FIG. 5 is a perspective view of a partially completed garment formed from the sleeve of FIG. 1 to which a gusset has been applied.
Figure 6:
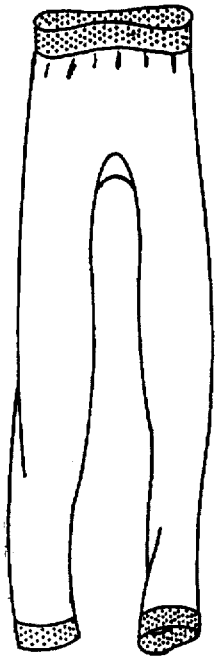
FIG. 6 is a perspective view of the completed garment of FIG. 5 containing a gusset.

Finished sleeve 10 also includes a cuff portion integrally knit with the leg portions that provides a finishing edge or dress cuff 30, 32 as best shown in FIG. 4. Seam 26 extends from first cuff 30 along the slit edges of first leg portion 16, adjacent the midriff encircling portion 14, along the second leg portion 18 and back to the second cuff portion 32.

In another embodiment of the present invention, an elongated tubular knit sleeve 36 includes an integrally knit shell 38 with an integrally knit lining 39, lining 39 joining shell 38 at waistband 40.

Figure 7:
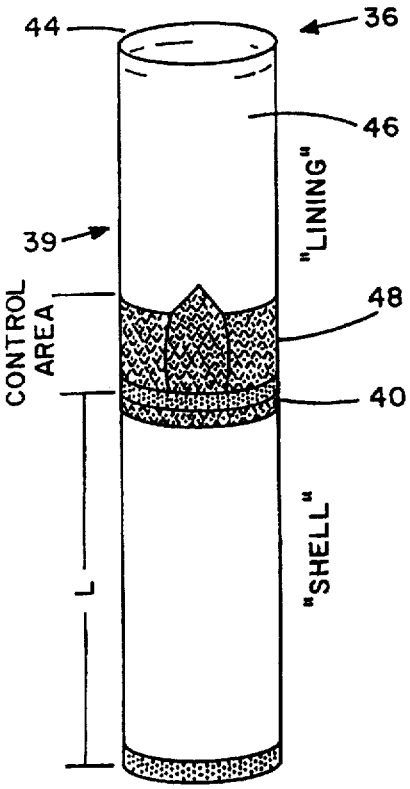
FIG. 7 is a perspective view of a tubular sleeve knit of successive yarn courses for forming a second embodiment of the present invention containing integrally knit shell and lining portions.

Sleeve 36 can be commenced at either end, although for the present discussion, commencement at the lower end of lining 37 will be assumed. Lining 39 will start with a dressed edge 44 which may be in the form of a welt so that it can ultimately function as the lower cuff of the lining. Leg enveloping portions are then integrally developed thereafter in the area shown as 46 in FIG. 7, and a midriff enveloping portion 48 is integrally knit thereto. Portion 48 can be knit of differing yarn and stitch construction to form a defined panty portion shown generally as 50. This portion can be formed of a more comfortable and functional yarn such as cotton, polypropylene or nylon and will be substantially lighter than the yarn used in shell 38.

Figure 8:
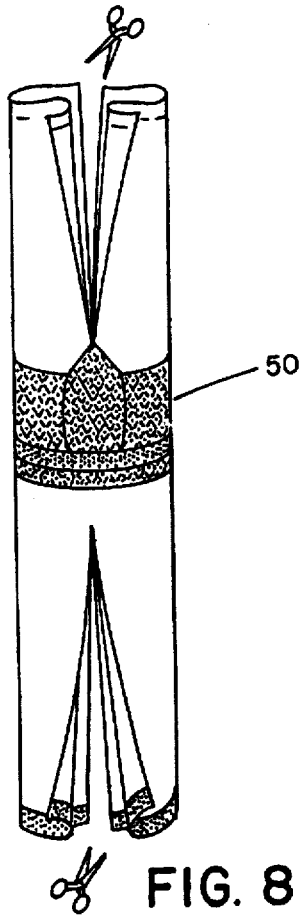
FIG. 8 is a perspective view of the tubular sleeve shown in FIG. 7 which has been slit from both ends to define leg portions.
Figure 9:
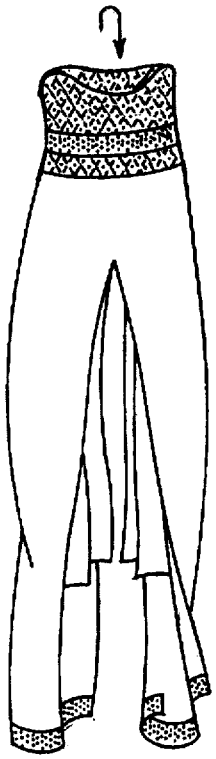
FIG. 9 is a perspective view of the partially everted alternative embodiment of the present invention formed from the sleeves of FIG. 7 and 8.
Figure 10:
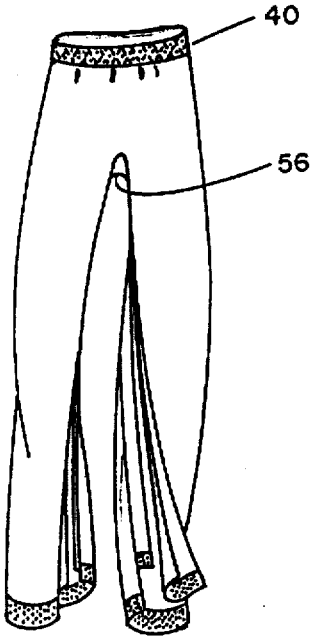
FIG. 10 is a perspective view of the fully everted garment with a gusset comprising the second embodiment of the present invention.
Figure 11:
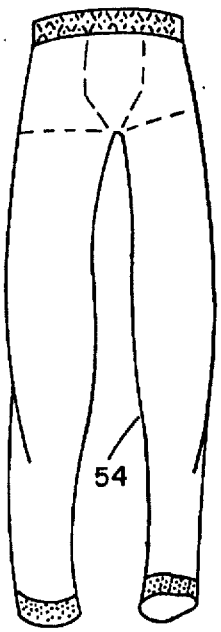
FIG. 11 is a perspective view of the completed garment forming the second embodiment of the present invention.

The balance of the garment, making up shell 38, is integrally formed as previously described with respect to the first embodiment of the present inventive concept. Knit tube 36 is then slit from both ends as shown in FIG. 8 and thereafter everted so that lining 46 is turned inwardly inside shell 38 and ultimately takes the form shown in FIG. 10 wherein waistband 40 is the folding area for lining 39 within shell 38. Once eversion is completed, both the slit leg portions of lining 39 and shell 38 are joined by the continuous longitudinal leg enclosing seam 54 (FIG. 11). Thus, the embodiment includes a garment having double layers with the longitudinal seam 54 capturing both the lining and shell and keeping the lining in place.

Figure 2:
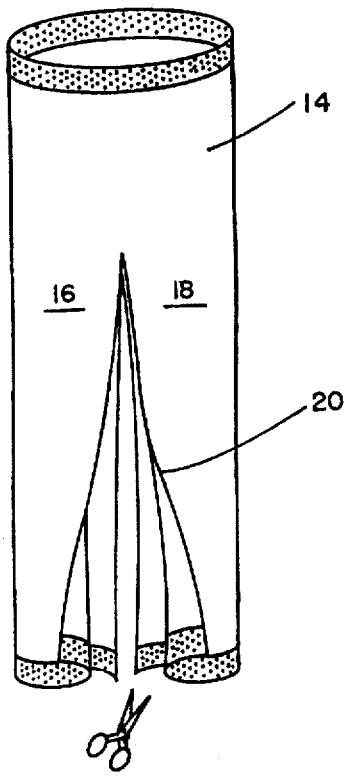
FIG. 2 is a perspective view of the tubular sleeve of FIG. 1 which has been slit longitudinally along the sleeve front and rear faces.
Figure 3:
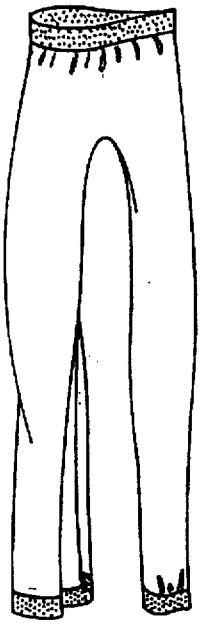
FIG. 3 is a perspective view of the partially completed garment formed from the slit tubular sleeve of FIG. 2.

Obviously, both embodiments may be provided with a gusset 56 as shown in FIG. 2 if that is desired. Moreover, the length of the garment can vary according to desired styling and is programmable on the knitting machine for whatever length is needed. Obviously, any number of yarns may be used to make up the various portions of the garment, it being essential only that integral knitting; i.e., uninterrupted circling knitting, take place during the yarn change. Panty portion 48 can be created to provide support panels or other decorative features or other fit characteristics, all of which are capable of being integrally produced on the knitting machine by various yarn and stitch configuration changes.

It will be understood that the details of construction and procedure of the invention set forth herein are merely by way of example and the invention is to be limited only by the scope of the appended claims.

What is claimed is:

1. A lower body garment for covering the legs, hips, waist and midriff of a wearer and formed from a tubular sleeve continuously knit of successive courses of yarn comprising: an integrally knit finished waistband or welt for maintaining the garment in position on the wearer; a midriff encircling portion integrally knit with the waistband; first and second leg portions integrally knit with the midriff encircling portion; and first and second cuff portions integrally knit with the first and second leg portions, the cuff and leg portions having a continuous slit forming slit edges, the edges seamed to provide a continuous leg enclosing seam extending from the first cuff portion along the first leg portion, adjacent a midriff encircling portion, along a second leg portion and back to the second cuff portion, the waistband further comprising a garment lining integrally knit thereto, the lining including a midriff encircling portion integrally knit with the waistband and leg enveloping portions integrally knit with the lining and a midriff encircling portion.

2. The garment as claimed in claim 1 wherein the lining leg enveloping portions have a continuous longitudinal slit forming slit edges, the edges seamed by the continuous longitudinal leg enclosing seam to secure the leg lining enveloping portions to the first and second leg portions.

3. The garment as claimed in claim 2 wherein the lining midriff encircling portion includes a panty defining portion.

4. The garment as claimed in claim 3 wherein the panty defining portion includes front, back and side portions formed of different yarn from the yarn of the midriff encircling portion.

5. The garment as claimed in claim 4 wherein the panty defining portion includes front, back and side portions formed of different yarn than the yarn of the first and second leg portions and the lining leg encircling portions.

6. A method of forming a lower body garment for covering legs, hips, waist and midriff of a wearer from a tubular sleeve continuously knit of successive courses of yarn comprising the steps of: knitting an integrally knit finished waistband or welt for maintaining the garment in position on a wearer; knitting a midriff encircling portion integrally with the waistband; knitting leg portions integrally with the midriff encircling portion; knitting cuff portions integrally with the leg portions; slitting the tubular sleeve forming slit edges to define leg portions; and seaming the slit edges of the defined leg portions to form leg portions for enclosing the legs of the wearer, the step of knitting the waistband further including commencing the knitting of the waistband by knitting a garment lining prior to and integrally with the waistband.

7. The method as claimed in claim 6 wherein the knitted garment lining includes lining leg enveloping portions and a lining midriff encircling portion.

8. The method as claimed in claim 7 wherein the leg lining enveloping portions are slit to form slit edges and the lining leg enveloping portion edges are seamed by the continuous longitudinal leg enclosing seam to secure the lining leg enveloping portions to the first and second leg portions.

* * * * *